United States Patent [19]

Marks

[11] 4,289,366

[45] Sep. 15, 1981

[54] BISEXUAL ELECTRICAL CONNECTOR

[76] Inventor: Dale H. Marks, 425 Benignus, Houston, Tex. 77024

[21] Appl. No.: 76,773

[22] Filed: Sep. 18, 1979

[51] Int. Cl.[3] ..... H01R 23/20

[52] U.S. Cl. ..... 339/49 B; 339/91 R; 339/119 C; 339/211

[58] Field of Search ..... 339/47 R, 47 C, 48, 339/49 R, 49 B, 91 R, 61 R, 61 M, 119 C, 211

[56] References Cited

U.S. PATENT DOCUMENTS

| | | | |
|---|---|---|---|
| 1,144,225 | 6/1915 | Mills | 339/49 R |
| 2,960,675 | 11/1960 | Hansen | 339/49 R |
| 2,963,677 | 12/1960 | Kallenborn | 339/48 |
| 3,275,969 | 9/1966 | Sheeran | 339/119 C |
| 3,337,836 | 8/1967 | Churla, Jr. | 339/49 B |

FOREIGN PATENT DOCUMENTS

| | | | |
|---|---|---|---|
| 2125858 | 12/1972 | Fed. Rep. of Germany | 339/91 R |
| 410098 | 10/1966 | Switzerland | 339/49 B |
| 1280477 | 7/1972 | United Kingdom | 339/47 R |

*Primary Examiner*—Neil Abrams

*Attorney, Agent, or Firm*—Browning, Bushman & Zamecki

[57] ABSTRACT

The invention comprises an electrical connection member including a main body and a connection formation extending generally from the main body. The connection formation includes walls extending from the main body and defining a pair of elongate, parallel, spaced apart shoulders. A female receptacle is recessed inwardly from the shoulders therebetween and adjacent one end thereof, and a male projection extends outwardly from the shoulders therebetween and adjacent the other end thereof by a distance no greater than the depth of the female receptacle. The connection formation further includes a generally planar interface surface, an inner portion of which defines a wall of the female receptacle, and an outer portion of which defines a wall of the male projection. The connection member can be matingly engaged with another connection member having a substantially identical connection formation. The interface surface of each of the two connection formations has a linear row of electrical contacts thereon. The interface surfaces form universal faces which are in identical positions on the respective ones of the connection formations but positioned to oppose each other when the connection formations are so matingly engaged. Furthermore, the configuration of the connection formations maintains a relative end-to-end order of the contacts of the respective rows of the universal faces, which order is the same whether the connection formations are identically oriented or matingly engaged.

21 Claims, 6 Drawing Figures

BISEXUAL ELECTRICAL CONNECTOR

BACKGROUND OF THE INVENTION

1. Field of the Invention

The present invention pertains to electrical connectors. The most conventional way of providing for electrical connection between two electrical members, such as two cables, a piece of electrical equipment and a cable, or two pieces of electrical equipment, is to provide a male connector or pin on one of the members and a female connector or socket on the other. In many instances, such an arrangement proves to be inconvenient for a variety of reasons. For example, in electronic operations such as sound systems a number of system components or members may frequently be moved or interchanged within the context of the system as a whole. Such changes in the system may introduce problems where the connectors of two components to be connected are incompatable with each other. For example, it may happen that the connectors of two components to be connected are both male or both female. Likewise, even though the connector of one such component may be male and the other female, they may still be incompatable due to differences in size, cross sectional configuration, etc. Accordingly, adaptors must be used to make such connections, and it can be appreciated that, the more different types of connectors there are among the components of a given system, the more different types of adaptors are needed to connect the various components in all possible combinations.

A somewhat similar problem may arise where a plurality of relatively long cable sections are connected in end-to-end relationship, for example in forming seismic cables. Where each cable section has a male connector at one end and a female connector at the other, it is necessary to arrange the sections so that the male connector of each is disposed adjacent, the female connector of the next section, or to provide adaptors for making male-to-male or female-to-female connections.

2. Description of the Prior Art

In an effort to solve these and similar problems in various types of electrical systems, a number of bisexual electrical connectors have been devised. Such connectors are provided with both male and female portions arranged such that two identical connectors can, when properly oriented, be matingly engaged with one another. Some such connectors, such as those shown in U.S. Pat. No. 2,086,641 to Riley and U.S. Pat. No. 741,052 to Mahon are designed only to make a single connection. Other connectors, such as those shown in U.S. Pat. No. 3,638,164 to Glance at el, U.S. Pat. No. 3,366,915 to Miller, and U.S. Pat. No. 3,745,511 to Fussell are adapted to make multiple electrical connections by matingly engaging only two of the connectors in question. However, such prior devices for making multiple connections in essence make such provision by providing both a plurality of male members and a plurality of female members on each connector.

Another problem with such prior art connectors, regardless of whether they are designed to make single or multiple connections, is that, even though two mating connectors may have identical external structural configurations, they are electrically dissimilar in the sense that the two contacts which must mate in order to connect a given pair of conductors are not located in identical positions on the respective connectors.

SUMMARY OF THE INVENTION

The present invention provides bisexual electrical connectors which may be matingly engaged with other such connectors having substantial identical connection formations. The connector of the present invention is provided with both male and female portions and thus may be termed a "bisexual" connector. However, the connector of the present invention is of an improved construction which provides several advantages over prior bisexual connectors. For example, while each of the connectors of the present invention includes only a single male portion and a single female portion, multiple connections may be made by matingly engaging two such connectors due to the unique configuration of the connection formations thereof and the arrangement of the electrical contacts on such formations. Nevertheless, such connection formations are relatively simple and easy to connect, and when connected, result in a smooth-sided closed structure free from external projections or recesses which could make the device dangerous or unattractive in appearance. Furthermore, by proper placement of the contacts, the connection formations may be made electrically similar as well as structurally identical.

In particular, an electrical connector assembly according to the invention comprises a pair of connector members having substantially identical but matingly engagable connection formations. Each of the connection formations includes a respective generally planar universal face having a linear row of electrical contacts thereon. The universal faces of the two connectors of the assembly are in identical locations on the respective connection formations but are positioned to oppose each other when the connection formations are matingly engaged. The connection formations are further configured to maintain a relative end-to-end order of the contacts of the respective rows of said universal faces, which order is the same whether the connection formations are identically oriented or matingly engaged.

More specifically, each of the connection formations comprises a female receptacle and a male projection adjacent to the receptacle, the universal face being disposed at the interface of the projection and receptacle. The universal face thus has an inner portion defining a wall of the female receptacle and an outer portion defining a wall of the male projection. Each of the connection formations preferably comprises wall means extending from the main body of the connection member and defining a pair of elongate, spaced apart shoulders. The female receptacle is recessed inwardly from said shoulders therebetween and adjacent one end thereof, while the male projection extends outwardly from said shoulders therebetween and adjacent the other end thereof by a distance no greater than the depth of the female receptacle. Thus, when the male projection of each of the two connection members is inserted in the female receptacle of the other connection member, each of the shoulders of one connection member abuts a respective shoulder of the other connection member to form a closure about the male projections and female receptacles.

The male projections and female receptacles are preferably polygonal in transverse cross section and have substantially planar end faces. These end faces, as well as the faces of the polygons other than those defined by the aforementioned universal faces, provide convenient sites for the location of additional electrical contacts thereby further increasing the number of connections which may be made by a single such assembly.

A connector according to a first embodiment of the invention may be connected to an identical connector so as to form a closed box-like assembly when the connection formations are properly matingly engaged, or alternatively, to matingly engage a second embodiment of connector at right angles thereto. The connectors may be provided with additional salient features such as detent means for retaining the connectors in a properly engaged position and holder means for holding a cable in a folded condition adjacent the main body of the connector.

Accordingly, it is a principal object of the present invention to provide an improved electrical connector assembly comprising a pair of connector members having substantially identical but matingly engageable connection formations.

Another object of the present invention is to provide such an assembly wherein each connector comprises a universal face having a row of electrical contacts thereon, the universal faces being in identical positions on the respective ones of the connection formations but positioned to oppose each other when the connection formations are matingly engaged.

Still another object of the present invention is to provide such an assembly wherein the connection formations are further configured to maintain a relative end-to-end order of the contacts of the respective rows of the universal faces, which order is the same whether said connection formations are identically oriented or matingly engaged.

Still another object of the present invention is to provide an electrical connector having an improved connection formation including a single male and a single female portion but adapted to make multiple electrical connections when matingly engaged with a connector having a substantially identical connection formation.

Still other objects, features, and advantages of the present invention will be made apparent by the following detailed description of the preferred embodiments, the drawings, and claims.

DESCRIPTION OF THE PREFERRED EMBODIMENTS

Figure 1:
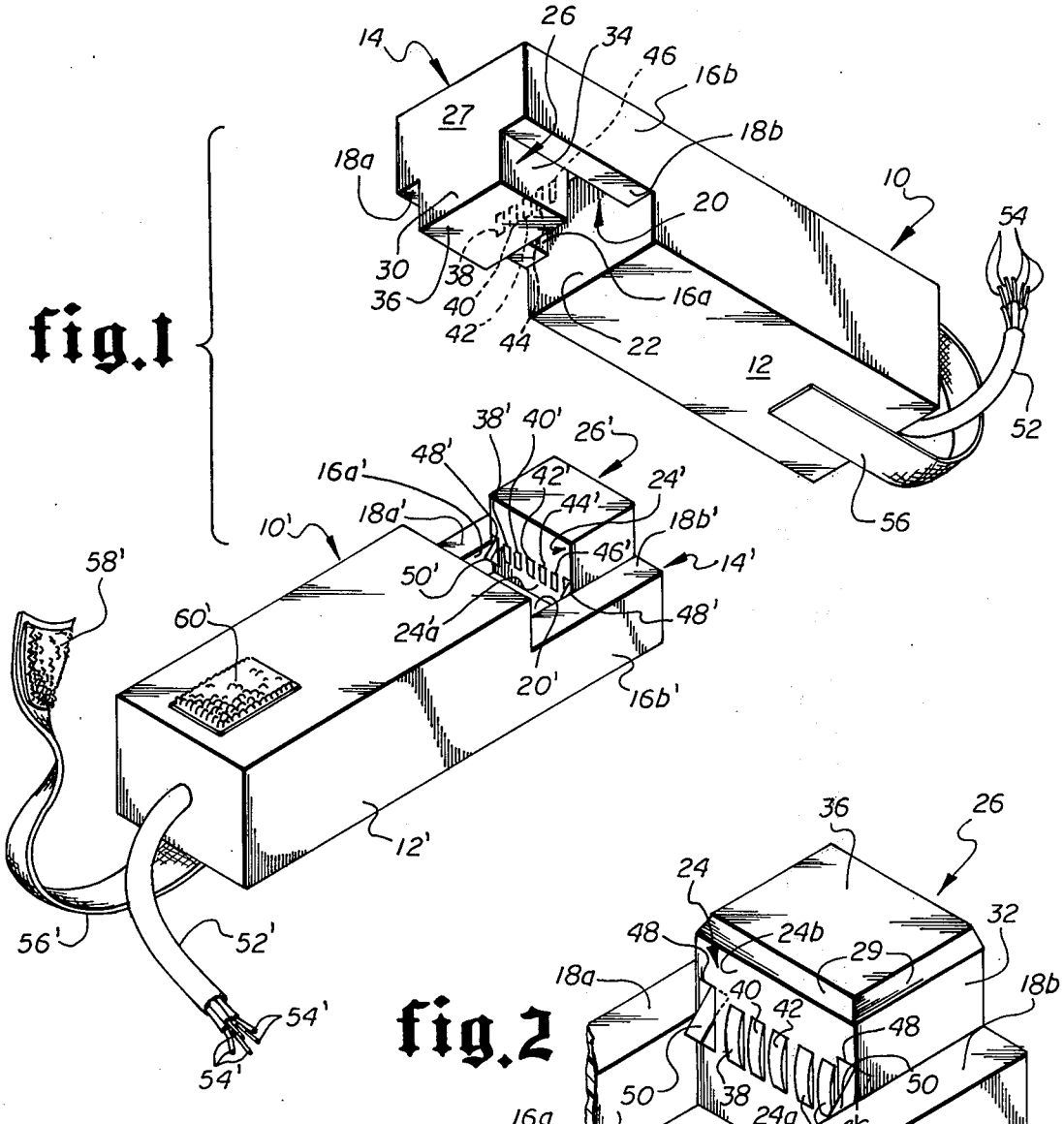
FIG. 1 is a perspective view of two substantially identical connectors according to the present invention in position to be matingly engaged.
Figure 2:
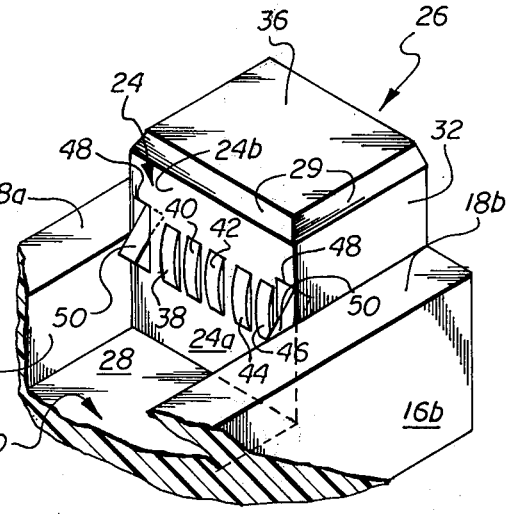
FIG. 2 is an enlarged perspective view of a portion of the connection formation of one of the connection members of FIG. 1.

Refering now to the drawings, FIG. 1 shows a pair of substantially identical electrical connectors or connection members 10 and 10' in position to be matingly engaged to form a connector assembly. Each of the connection members 10 and 10' comprises a main body 12 or 12' whose configuration is that of a rectangular parallelepiped. Connector 10 has a connection formation 14 exetnding outwardly from one end of main body 12, while connector 10' has a substantially identical connection formation 14' extending outwardly from one end of main body 12'. FIG. 2 shows the major portion of connection formation 14 in greater detail. By comparing FIGS. 1 and 2, it can be seen that connection formation 14 includes a pair of parallel, spaced apart walls **16*a* and 16*b* which extend outwardly from main body 12 generally lengthwise with respect thereto and defining a pair of parallel, coplaner, spaced apart shoulders 18*a* and 18*b*. A female receptacle 20 of rectangular transverse cross section is recessed inwardly from shoulders 18*a* and 18*b* therebetween, i.e. has opposite side faces thereof defined by walls 16*a* and 16*b*, at the end of walls 16*a* and 16*b* adjacent main body 12. Two other opposed side faces of receptacle 20 are defined respectively by the adjacent end face 22 of main body 12 and the inner portion 24*a* one of the faces 24 of a block-like element disposed between the ends of walls 16*a* and 16*b* distal main body 12 to form an end wall 27. The bottom of recess 20 is formed by a bottom wall 28 interconnecting walls 16*a* and 16*b* distal shoulders 18*a* and 18*b***.

The block-like element which forms end wall 27 extends outwardly beyond shoulders **18*a* and 18*b* therebetween so that the portion thereof so extending forms a male projection 26 of rectangular transverse cross-sectional configuration. Said male projection has one pair of opposite side faces defined respectively by the outer portion 24*b* of the aforementioned surface 24 and by the outer portion 30 of the outer end surface of connection formation 14 as a whole. Male projection 26 also has two other opposite side faces 32 and 34 and a generally planar outer end surface 36**.

At this point, it is noted that terms such as "bottom," "inner," "outer," and "transverse," when used with respect to the connection formations of the connectors described herein should be construed with respect to the respective male projections and female receptacles, e.g. as viewed in FIG. 2. Such terms are used for convenience of description only, and should not be construed in a limiting sense as to the various positions which a connector might assume in use.

Referring again to FIG. 2, surface 24, which is disposed at the interface of male projection 26 and female receptacle 20 and defines portions of each, may thus be referred to as an "interface surface," and for reasons to be described more fully below, as the "universal face" of connection formation 14. Face 24 has a linear row of contacts 38, 40, 42, 44 and 46 mounted thereon at the juncture between inner portion **24*a* and outer portion 24*b*, i.e. adjacent shoulders 18*a* and 18*b*. The row of contacts 38–46 extends generally in the direction from wall 16*a* toward wall 16*b*. Each of the contacts 38–46 is of an asexual type, i.e. is neither male or female. The contacts are formed of spring metal and are slightly curved as shown in FIG. 2 so as to be resilently biased outwardly from surface 24. On either side of the row of contacts 38–46, face 24 is provided with a set of detent formations. Each such set of detent formations includes an outermost wedge-shaped recess 48 and a wedge-shaped snap detent 50 disposed just inwardly of the respective recess 48**.

By comparing FIGS. 1 and 2 it can be seen that the connection formation 14' of connector 10' is substantially identical to connection formation 14 of connector 10. Accordingly, the various parts of formation 14' have been given reference characters corresponding to those of the analogous parts of formation 14 with the addition of the symbol "'". More specifically, like formation 14, formation 14' includes a pair of walls **16*a*' and 16*b*' defining parallel, coplanar, spaced apart shoulders 18*a*' and 18*b*'. A rectangular female receptacle 20' is recessed inwardly from and located between shoulders 18*a*' and 18*b*' at the ends thereof close to main body 12' of the connector. The other ends of walls 16*a*' and 16*b*' are connected by a block-like element which extends outwardly from shoulders 18*a*' and 18*b*' and therebetween to form a male projection 26' of generally rectangular cross-sectional configuration. A universal face 24', disposed at the interface between female receptacle 20' and male projection 26' has an inner portion 24*a*' defining one of the side faces of receptacle 20' and an outer portion 24*b*' defining one of the side faces of male projection 26'. At the juncture between its inner and outer portions universal face 24' has a linear row of contacts 38', 40', 42', 44' and 46' mounted thereon. On either end of the row of contacts 38'–46', there is a set of detent formations including an outer-most wedge-shaped recess 48' and an innermost wedge-shaped snap detent 50'**.

As a comparison of FIGS. 1 and 2 shows, if connectors 10 and 10' are disposed so that their respective connection formations 14 and 14' are identically oriented, the respective universal faces 24 and 24' thereof are disposed in identical locations. Furthermore, contact 38 is in the same location on its respective universal face 24, i.e. at the far left as viewed in FIG. 2, as is contact 38' on face 24'. The same is true of contacts 40 and 40', contacts 42 and 42', contacts 44 and 44', and contacts 46 and 46', each such pair being located slightly farther to the right as the connectors 10 and 10' are viewed in FIGS. 1 and 2. To matingly engage connectors 10 and 10', the former would be rotated 180° about an axis parallel to the row of contacts 38–46 to the position shown in FIG. 1. In this position male projection 26 can be inserted in female receptacle 20' of the other connector 10', while female receptacle 20 is positioned to receive male projection 26'. The male projections 26 and 26' have bevelled outer edges (see 29 in FIG. 2) to facilitate insertion into female receptacles 20' and 20. The assexual nature and spring biasing of contacts 38–46 and 38'–46' permits them to slide past each other when the connectors are being engaged or disengaged but maintains firm electrical contact in the assembled or engaged condition.

Even though universal faces 24 and 24' are disposed in identical locations on the respective connection formations 14 and 14', they oppose each other when the connection formations are matingly engaged. Furthermore, when the connection formations are so engaged or are positioned for such engagement as shown in FIG. 1, the same end-to-end relationship between the two rows of contacts 38–46 and 38'–46' is maintained as when the connection formations were identically oriented. In other words, contacts 38 and 38' are still located on the far left of their respective universal faces, and contacts 46 and 46' are located on the far right. Accordingly, each of the contacts will abut an identically positioned contact when the connection formations are matingly engaged. It is for this reason that faces 24 and 24' are referred herein as "universal faces."

At the opposite end of connector 10 from its connection formation 14, an electrical conduit 52 extends into the main body 12 thereof. Conduit 52 contains five electrical conductors 54. Each of the conductors 54, which may ultimately be communicted with various equipment, and/or conventional connectors extends through the connector 10, which may be hollow or provided with internal passageways (not shown), to a respective one of the contacts 38–46. Likewise, connector 10' has an electrical conduit 52' encasing five electrical conductors 54' extending into the end of its main body 12' distal connection formation 14'. Each of the conductors 54' is electrically connected to a respective one of the contacts 38'–46'. Because of the universality of faces 24 and 24', i.e. that characteristic by which a contact of one connector engages an identically located contact of the other connector when the two connectors are matingly engaged, each two conductors 54 and 54' to be connected to each other may be connected to respective identically located contacts. Thus, the connection formations 14 and 14' are not only structurally identical but also electrically similar in this sense. This feature not only simplifies the connector but does so without the need for separate pins and sockets for each pair of conductors to be connected.

Figure 3:
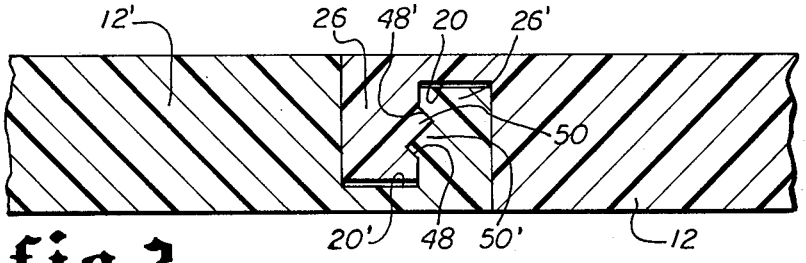
FIG. 3 is a longitudinal cross-sectional view of the connectors of FIG. 1 in mating engagement taken in the plane of one set of detents thereof.

Referring now to FIG. 3 in conjunction with FIGS. 1 and 2, male projection 26 extends outwardly beyond shoulders **18*a* and 18*b* by a distance no greater than the depth of receptacle 20. Also, shoulders 18*a* and 18*b* are located approximately half way along one lateral dimension of main body 12, i.e. the top to bottom dimension as viewed in FIGS. 1 and 3. Accordingly, when the connectors are matingly engaged, shoulder 18*a* will abut shoulder 18*a*', and shoulder 18*b* will abut shoulder 18*b*' so that a closure is formed about the male projections and female receptacles. The sides of such closure are continuous with those of the main bodies 12 and 12'** so that the connected assembly has a generally smooth-sided external configuration, more specifically that of a rectangular parallelpiped, free of projections or cavities which could be unattractive in appearance, cause the connector to become caught on other objects, etc.

As shown in FIG. 3, the receptacles 20 and 20' may be slightly deeper than the male projections 26 and 26' received therein. However, the lateral dimensions of such male projections are sized to provide a fairly snug fit with the female receptacles. This, together with the spring biasing of contacts 38–46 and 38'–46' insures proper electrical connections at such contacts. FIG. 3 also shows the manner in which the detents 50 of connector 10 snap into the recesses 48' of connector 10', and the detents 50' of the latter connector snap into the recesses 48 of the former. For this purpose, the connectors 10 and 10', including detents 50 and 50' may be formed of a resilient but relatively firm plastic to permit the necessary snapping engagement and disengagement of the detent formations. It should also be noted that the size of the detent formations has been greatly exaggerated for purposes of illustration, and that in actual practice such formations would be quite small so that they would not impose undue resistance to assembly and disassembly of the connectors but would nevertheless maintain proper alignment of the contacts of the respective connectors (in the vertical direction as viewed in FIG. 3) and help retain the connection formations in mating engagement.

Each connector 10 or 10' is also provided with holder means so that the respective electrical conduit can be coiled or otherwise folded upon itself and retained adjacent the main body of the connector in such folded condition. In the embodiment shown, the connectors 10 and 10' are provided with such holders in the form of respective flexible straps 56 and 56'. Each such strap has at least one end removably securable to one side of the main body. For example, the strap 56' and main body 12' are provided with pressure activated attachment pads 58' and 60' of the type available commercially under the trademark "velcro." The other end of the strap is secured to the opposite side of main body 12' either permanently or removably. Thus, the strap may be passed from one side to the other across the end of the main body from which the electrical conduit extends as shown at 56 in FIG. 1.

Figure 4:
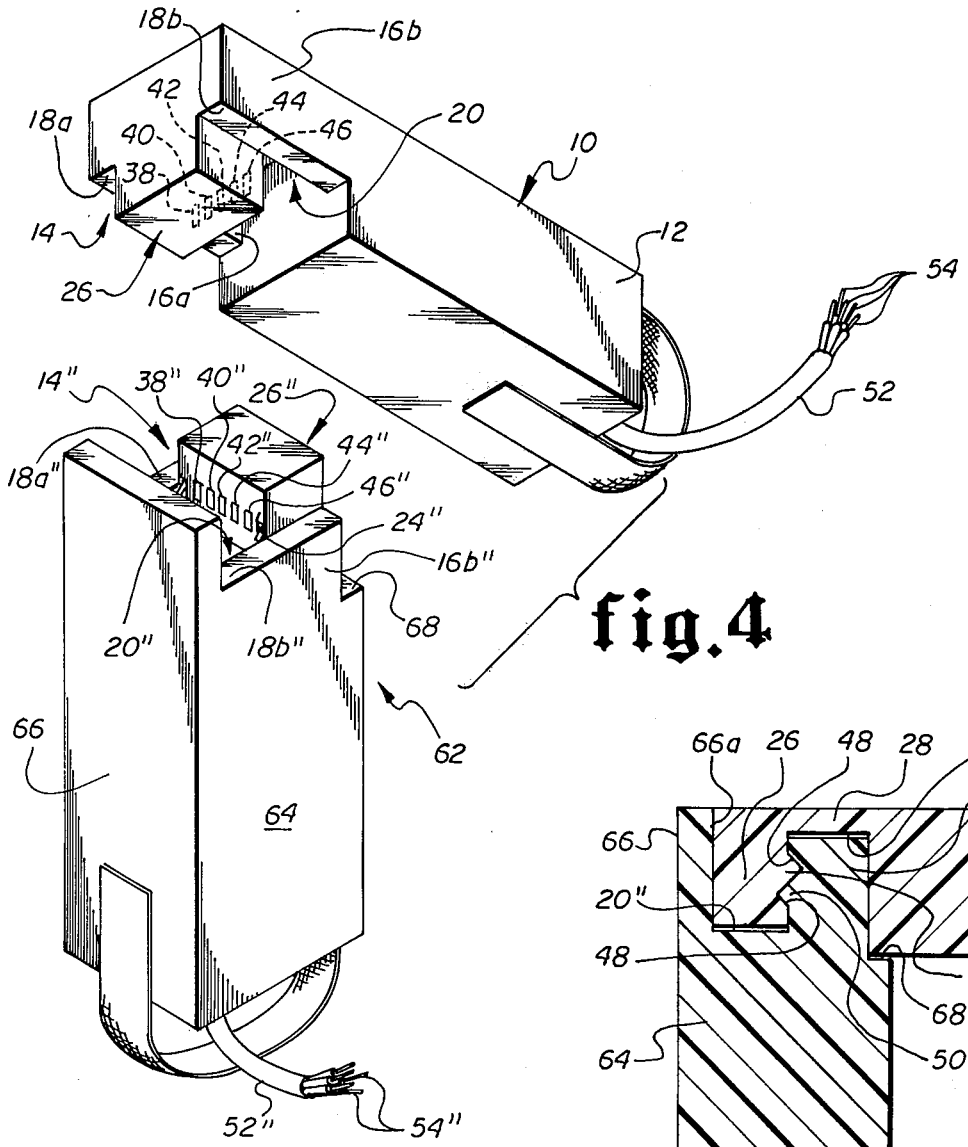
FIG. 4 is a perspective view of two connectors according to the present invention, one of which is of a modified form, in position to be matingly engaged.

Referring now to FIG. 4 connector 10 is shown in position for mating engagement with a second embodiment of connector 62. Like connectors 10 and 10', connector 62 comprises a main body 64 and a connection formation 14'', the major difference being the orientation of the main body with respect to the connection formation. Connection formation 14'' is substantially identical in configuration per se to connection formation 14, and accordingly, various parts of formation 14'' have been denoted by the same numerals as analogous parts of formation 14 but with the symbol "''" appended thereto. More specifically, like formation 14, formation 14'' includes a pair of walls **16*a*'' and 16*b*'' defining parallel, coplanar, spaced apart shoulders 18*a*'' and 18*b*''. However, shoulders 18*a*'' and 18*b*'' extend generally endwise with respect to main body 64 rather than lengthwise as in the preceeding embodiments. Accordingly, the female receptacle 20'' recessed inwardly from shoulders 18*a*'' and 18*b*'' therebetween and at one end thereof and the male projection 26'' extending outwardly from shoulders 18*a*'' and 18*b*'' and therebetween at the other end thereof face generally endwise with respect to the main body 64, rather than generally laterally as in the other embodiments. Otherwise, recess 20'' and projection 26''** are of precisely the same configuration and size as the receptacles and projections of the preceeding embodiments.

Likewise, connection formation 14'' includes a universal face 24'' the inner portion of which defines a wall of receptacle 20'' and the outer portion of which defines a wall of male projection 26''.

Figure 5:
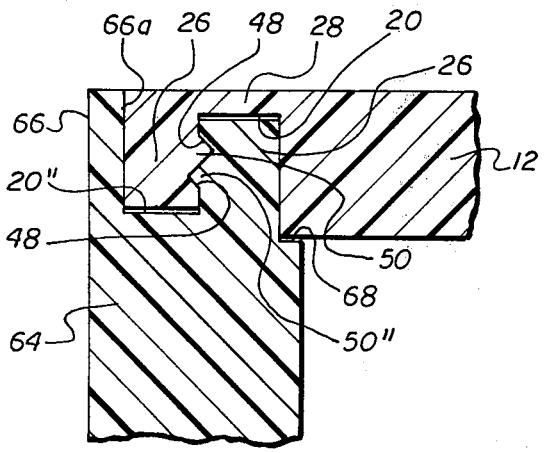
FIG. 5 is a cross-sectional view of the connectors of FIG. 4 in mating engagement taken in the plane of one set of detents thereof.

Main body 64 further differs from the main bodies of the preceeding embodiments in that it is provided with a tongue 66 extending generally lengthwise outwardly to interconnect the ends of walls 16'' and **16*b*'' thereby defining the side face of receptacle 20'' opposed to universal face 24''. Tongue 66 further extends outwardly beyond shoulders 18*a*'' and 18*b*'' so that the same surface 66*a* thereof (see FIG. 5) which defines such receptacle side face also opposes the outer portion of universal face 24'' located on male projection 26''. Tongue 66 preferably extends outwardly even further than surface 24'' by a distance substantially equivalent to the thickness of bottom wall 28 of connection formation 14. Accordingly, when the connectors 10 and 62 are matingly engaged by inserting projection 26 into receptacle 14'' and projection 26'' into receptacle 20, as shown in FIG. 5, a smooth-sided angular structure will be formed. If desired, main body 64 may also be provided with a shoulder 68 for opposition to and/or abutment with main body 12 adjacent receptacle 20**.

Referring again to FIG. 4, a linear row of contacts 38''–46'' extend across universal face 24'' in the general direction from shoulder **18*a*'' towards shoulder 18*b*'' at the juncture between the inner and outer portions of face 24''. The universal quality of faces 24 and 24'' insure that the same end-to-end relationship between the two rows of contacts 38–26 and 38''–26'' is maintained whether the connection formation 14 and 14'' are identically oriented or positioned for mating engagement. Thus, each of the five conductors 54 which extend into connector 10 may be electrically connected with the proper one of the conductors 54'' extending into connector 62 by a pair of identically located contacts, e.g. 38 and 38''. Face 24'' is also provided with detent recesses 48'' and snaps 50'' for engagement with the detent formations 48 and 50 of connector 10** to maintain mating engagement and proper alignment of the contacts.

It can also be seen that the connector 62, in addition to being connectable to connector 10 to form an angular body as described above, could be connected to another connector identical to itself. The provision of a tongue 66 and shoulder 68 on such two connectors would cause the resulting assembly to form a smooth-sided, closed parallepid, as was the case when identical connectors 10 and 10' were assembled together.

Figure 6:
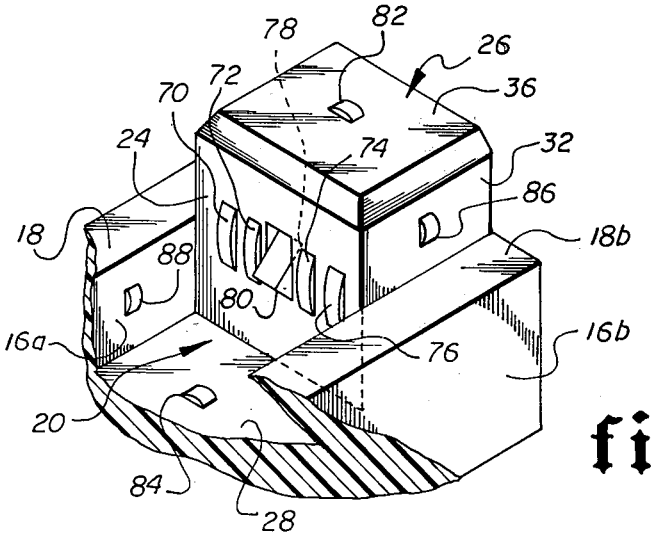
FIG. 6 is an enlarged perspective view of a portion of a modified connection formation.

Referring now to FIG. 6 there is shown a modified connection formation for mating engagement with an identical connection formation. The connection formation of FIG. 6 is identical in external configuration to the formation 14 of connector 10, and accordingly, like parts have been given like reference numerals. The formation of FIG. 6 differs from formation 14 only in the arrangement of the contacts and detent formations. A linear row of four contacts 70, 72, 74, and 76 is mounted on the universal face 24. The detent formations, including a single outermost wedge-shaped recess 78 and a single wedge-shaped snap detent 80 therebelow, are disposed on the vertical centerline of face 24 intermediate contacts 72 and 74.

Because of the universal character of face 24, contacts 70–76 thereof can each mate with an identically located contact on a similar connector. Because of the polygonal cross-sectional configuration of receptacle 20 and the substantially planar end face thereof formed by bottom wall 28, and because of the similar polygonal configuration of projection 26 and the planar end face 36 thereof, a number of other convenient sites for the location of additional electrical contacts are provided. Although multiple contacts could be provided on each such planar face, for simplicity of illustration, a single contact 82 has been shown in the center of end face 36 of projection 26. Likewise, a single contact 84 has been shown in the center of the end face of receptacle 20 defined by bottom wall 28. It can be seen that, if the connection formation shown in FIG. 6 were matingly engaged with an identical formation, the contact 82 of one connector would engage the contact 84 of the other and vice versa. Accordingly, even though the mating contacts are not identically positioned as with universal faces 24, so that electrical similarlity is not maintained, two more pairs of conductors could be connected.

Alternatively, if electrical similarity were desired, it could be maintained by employing two contacts per conductor per connector. For example, if a single conductor had two leads extending therefrom in parallel, one to contact 82 and the other to contact 84, and another conductor had similar leads extending to identically located contacts in a second connector, the pair of conductors could be connected by the two pairs of contacts with electrical similarity—as used herein—maintained.

Likewise, a contact 86 is mounted on side face 32 of projection 26. A similar contact would be mounted on the opposite side face (not shown, but compare 34 in FIG. 1). Similarly, a contact 88 is provided on the side face of receptacle 20 defined by wall 16*a*, and a similar contact (not shown) would be provided on the face defined by wall 16*b*. Accordingly, if two identical connectors of the type shown in FIG. 6 are matingly engaged, the contacts on the side faces 32 and 34 of the male projections would engage respective contacts on the side faces of the female receptacles so that one or two more pairs of electrical conductors could be connected depending on whether or not electrical similarity was maintained. Additional contacts could be provided on faces 30 and 22 (see FIG. 1). Also, extra contacts could be mounted on universal face 24 either above or below the central row 70–76, which contacts—while not preserving electrical similarity as defined above unless used two per conductor—would allow even more connections to be made. Accordingly, it can be seen that, over and above the advantages provided by the universal face 24, an electrical connector configured in accord with the present invention can provide for multiple connections through an assembly comprised of only two connectors, each of which has only a single male projection and a single female receptacle.

As mentioned above, the electrical conduits, e.g. 52, of the connectors described above might have their opposite ends directly connected to various pieces of equipment which could be connected to one another by use of the connectors of the invention. However, connectors according to the invention can also be used in adaptors for allowing electrical system components having incompatable connectors to be electrically connected. When used in this manner, the conduit extending from each of the connectors of the invention would have at its other end a conventional connector adapted to connect to one or another of several more or less conventional system components. Because the connection formations of the bisexual connectors of the present invention are identical, use of the present invention in such adaptors can reduce the number of adaptors needed to make all possible connections in a given system of components.

To illustrate by way of a very simple example, assume there is a system having four components, each with a different type of connection formation, the four connector types being referred to respectively as A, B, C, and D. Using conventional adaptors, in order to provide for connections of each of these four pieces of equipment selectively to any of the other three, the following types of adaptors would be needed.

A to B
A to C
A to D
B to C
B to D
C to D.

By using adaptors having a connector according to the invention (U) at one end and a conventional type connector at the other, the following types of adaptors would be needed to make all possible combinations of connections between the four system components of the above example:

A to U
B to U
C to U
D to U.

Thus, even in this extremely simple example, involving only four system components, the number of adaptors needed to make all possible interconnections would be reduced from six to four by use of the present invention. As the number of components increases, the advantage multiplies. Furthermore, as explained above, a connector according to the present invention can be designed, either by use of multiple contacts on the universal face thereof and/or by the provision of contacts on various other faces, to make a number of connections at once. Accordingly, in complicated systems, the number of adaptors needed to make various combinations of connections could be even further reduced.

Numerous modifications of the preferred embodiments of the present invention described above can be made without departing from the spirit of the invention. For example, while the projections and receptacles of the connectors shown are rectangular in cross section, other polygonal cross sections could be used, and in less preferred embodiments, round or otherwise curved cross sectional configurations could be employed along with suitable keys or the like to maintain proper alignment.

Also, while the connectors shown are illustrated as if the various electrical conductors are preconnected to the respective contacts and the connector body permanently intergrally formed therearound, connectors of the invention could be provided with removable wall sections to permit connection of various conductors to the contacts as desired. Likewise, rather than encasing the various conductors in a single conduit which extends into the main body of the connector, the exterior of the connector could be provided with contact points preconnected to respective ones of the contacts of the connection formation and in turn connectable to electrical conductors or lead wires as desired.

Other modifications might involve, for example, changes in the type of holder means provided for retaining the electrical conduits in a coiled or otherwise folded condition adjacent the connector body. Still other modifications will suggest themselves to those of skill in the art. Accordingly, it is intended that the scope of the present invention be limited only by the claims which follow.

I claim:

1. An electrical connector assembly comprising a pair of connector members having substantially identical connection formations matingly engageable by urging said formations toward each other in one directional mode, each of said connector members comprising a main body with connection formation extending therefrom; and each of said connection formations comprising wall means extending from said main body and defining a pair of elongate, spaced apart shoulders; each of said connection formations further including a female receptacle recessed inwardly from said shoulders therebetween and adjacent one thereof, a male projection adjacent said receptacle extending outwardly from said shoulders therebetween and adjacent the other end thereof, by a distance no greater than the depth of said female receptacle, and a respective generally planar universal face disposed at the interface of said male projection and said female receptacle and having an inner portion defining a wall of said female receptacle and an outer portion defining a wall of said male projection; each of said universal faces having a linear row of electrical contacts thereon, said connection formations further being configured to maintain a relative end-to-end order of the contacts of the respective rows of said universal faces, which order is the same whether said connection formations are identically oriented or matingly engaged; whereby, when the male projection of each of said connector members is inserted in the female receptacle of the other connector member, each of the shoulders of one connector member abuts a respective shoulder of the other connector member to form a closure about said male projections and female receptacles, and said assembly has a generally smooth, continuous outer surface extending transverse to said one directional mode and defined by flush adjacent portions of said two connector members; the main body of one of said connector members being generally in the form of a rectangular parallelepiped, and the shoulders of said one connector member extending generally lengthwise with respect to the respective main body.

2. The assembly of claim 1 wherein said male projections and female receptacles are polygonal in transverse cross section.

3. The assembly of claim 2 wherein said male projections have substantially planar outer end faces and said female receptacles have substantially planar inner end faces.

4. The assembly of claim 2 wherein said male projections and female receptacles are rectangular in transverse cross section.

5. The assembly of claim 4 wherein said male projections have beveled outer edges.

6. The assembly of claim 1 wherein the other of said connector members is identical to said one connector member, and wherein the shoulders of each of said connector members are disposed approximately half way along one lateral dimension of the main body thereof; said assembly, when said connection formations are so matingly engaged, forming a box-like structure having two such outer surfaces on opposite sides thereof.

7. The assembly of claim 1 wherein the main body of the other of said connector members is generally in the form of a rectangular parallelepiped, the shoulders of said other connector member extending generally endwise with respect to the respective main body.

8. The assembly of claim 7 wherein said other connector member comprises a tongue extending outwardly from the ends of said shoulders distal said male projection to oppose the outer portion of said universal face of said one connector member and partially define said outer surface of said assembly.

9. The assembly of claim 1 wherein the row of contacts of each of said universal faces extends generally in the direction from one of said shoulders toward the other.

10. The assembly of claim 9 wherein said contacts are asexual.

11. The assembly of claim 10 wherein said contacts are resiliently biased outwardly from the respective one of said universal faces.

12. An electrical connector assembly comprising a pair of connector members having substantially identical connection formations matingly engageable by urging said formations toward each other in one directional mode, each of said connection formations comprising a female receptacle and a male projection adjacent said receptacle, and a respective generally planar universal face disposed at the interface of said male projection and said female receptacle and having an inner portion defining a wall of said female receptacle and an outer portion defining a wall of said male projection, wherein each of said universal faces has resilient detent means extending therefrom and recess means for receipt of the detent means of the other of the universal faces, each of said universal faces further having a linear row of electrical contacts thereon, said universal faces being in identical positions on the respective ones of said connection formations but positioned to oppose each other when said connection formations are so matingly engaged, said connection formations further being configured to maintain a relative end-to-end order of the contacts of the respective rows of said universal faces, which order is the same whether said connection formations are identically oriented or matingly engaged; and said assembly, when said connection formations are so matingly engaged, having a generally smooth, continuous outer surface extending transverse to said one directional mode and defined by flush adjacent portions of said two connector members.

13. The assembly of claim 12 wherein each of said connection members includes a main body, said connection formation being disposed generally at one end of said main body, and an electrical conduit extending outwardly generally from said main body in a direction transverse to said one directional mode.

14. The assembly of claim 13 wherein each of said connection members further includes holder means comprising a strap extending from one side of said main body to the other across the other end thereof, at least one end of said strap being removably securable to said main body for retaining said electrical conduit in a folded condition adjacent said other end of said main body.

15. An electrical connection member including a main body and a connection formation extending generally endwise from said main body in a first direction, said connection formation including:

wall means extending from said main body and defining a pair of parallel shoulders elongated in said first direction and spaced apart in a second direction transverse to said first direction, a female receptacle recessed inwardly from said shoulders therebetween and adjacent one end thereof, and a male projection extending outwardly from said shoulders therebetween and adjacent the other end thereof by a distance no greater than the depth of said female receptacle;

said connection formation further including an interface surface, an inner portion of said interface surface defining a first side face of said female receptacle, and an outer portion of said interface surface defining a first side face of said male projection;

said connection member as a whole having an outer end surface generally parallel to said interface surface and having an outer portion defining a second side face of said male projection opposite the first side face thereof;

and said main body having an end surface generally parallel to said interface surface and having an inner portion defining a second side face of said female receptacle opposite the first side thereof, said end surface of said main body being substantially identical in size and shape to said outer end surface of said connection member as a whole but opposite from said outer end surface of said connection member as a whole in orientation in a third direction transverse to said first and second directions.

16. The assembly of claim 15 wherein said male projection has a substantially planar outer end face and said female receptacle has a substantially planar inner end face.

17. The connection member of claim 16 wherein said male projection and said female receptacle are generally rectangular in cross section.

18. The connection member of claim 17 wherein said male projection has beveled outer edges.

19. The connection member of claim 15 wherein said main body is generally in the form of a rectangular parallelpiped, said shoulders being disposed approximately half way along the lateral dimension of said main body measured transverse to both said first and second directions.

20. The connection member of claim 15 further comprising electrical conduit means projecting endwise from said main body in a direction generally opposite to said first direction.

21. The connection member of claim 15 wherein said interface surface is generally planar.

* * * * *